United States Patent [19]

Neuer

[11] Patent Number: 4,608,517

[45] Date of Patent: Aug. 26, 1986

[54] FACEPLATE ASSEMBLY HAVING INTEGRAL GAUGING MEANS

[75] Inventor: David D. Neuer, Lancaster, Pa.

[73] Assignee: RCA Corporation, Princeton, N.J.

[21] Appl. No.: 625,804

[22] Filed: Jun. 28, 1984

[51] Int. Cl.[4] ..... H01J 29/02; H01J 40/02; H01J 1/34

[52] U.S. Cl. ..... 313/477 R; 313/482; 313/541; 220/2.1 A

[58] Field of Search ..... 313/477 R, 482, 541, 313/544, 476; 220/2.1 A

[56] References Cited

U.S. PATENT DOCUMENTS

| | | | |
|---|---|---|---|
| 2,682,620 | 6/1954 | Sanford | 313/402 X |
| 2,761,990 | 9/1956 | Amdursky et al. | 313/70 |
| 2,999,220 | 9/1961 | Werner | 339/146 |
| 3,030,536 | 4/1962 | Hackett et al. | 313/80 |
| 3,969,648 | 7/1976 | Hergenrother et al. | 313/482 |
| 4,024,579 | 5/1977 | Hergenrother et al. | 358/231 |
| 4,045,701 | 8/1977 | Dougherty | 313/408 |
| 4,084,113 | 4/1978 | Vogelpohl | 313/408 |
| 4,107,569 | 8/1978 | Ronde | 313/402 |
| 4,243,905 | 1/1981 | van Geest et al. | 313/102 |
| 4,365,183 | 12/1982 | Kloss | 313/478 |
| 4,409,515 | 10/1983 | Kloss | 313/477 R |

*Primary Examiner*—Palmer C. DeMeo
*Assistant Examiner*—Sandra L. O'Shea
*Attorney, Agent, or Firm*—Eugene M. Whitacre; Dennis H. Irlbeck; Vincent J. Coughlin, Jr.

[57] ABSTRACT

A faceplate assembly includes a faceplate flange, a faceplate member and a sealing material, such as a glass frit, for sealing the faceplate member to the faceplate flange. Three gauging members, integral with the flange, are in contact with the faceplate member to ensure that the faceplate member is sealed parallel to the faceplate flange and at a predetermined distance therefrom.

3 Claims, 3 Drawing Figures

FACEPLATE ASSEMBLY HAVING INTEGRAL GAUGING MEANS

BACKGROUND OF THE INVENTION

The invention relates to a faceplate assembly for an imaging device and, more particularly, to a faceplate assembly having a faceplate flange with integral gauging means which permits a faceplate member to be sealed parallel to the faceplate flange and at a predetermined distance therefrom.

In imaging devices, such as camera tubes and image intensifier tubes, a lens focuses the image of a scene onto an input faceplate of the device. Many camera tubes, such as silicon intensifier tubes, image isocons, intensified vidicon tubes and intensified charge coupled devices, utilize a photoemissive cathode as a light sensor on the interior surface of the input faceplate. Photons, comprising the image of the scene, pass through the input faceplate of the device into the photoemissive cathode. The incident photons produce photoelectrons which are accelerated to a target or to a charge coupled device. In order to minimize distortion of the ultimate image, it is necessary that the image of the scene be focused over the entire input faceplate of the device. This requires a flat, substantially parallel input faceplate.

Typically, the input faceplate comprises a plano-concave fiber optic which is frit sealed to a faceplate flange to form a faceplate assembly. One such structure is shown in U.S. Pat. No. 4,243,905, issued to van Geest et al. on Jan. 6, 1981. Frequently, because of variations in the thickness of the frit layer, the faceplate is slightly tilted relative to the faceplate flange. The tilting of the faceplate is undesirable because the image of the scene is not sharply focused over the entire faceplate area. Such tilting results in a decrease in resolution of the ultimate image. Additionally, the faceplate tilt introduces spacing variations within the tube which further degrade the resolution. The resolution degradation is most pronounced in diode-type tubes in which the electron-optical focusing is optimized for a predetermined spacing between the interior surface of the faceplate and the anode.

In tubes in which the input faceplate is not sealed parallel to the faceplate flange, it is necessary to grind and polish the exterior surface of the faceplate, after tube fabrication, to obtain the necessary parallelism for proper scene focusing on the input faceplate. Such a grinding and polishing operation is time consuming, expensive and occasionally results in the loss of a finished tube due to mishandling or the generation of particles within the tube as a result of the vibration of the grinding and polishing operation.

SUMMARY OF THE INVENTION

A faceplate assembly includes a faceplate flange having a sealing surface, a faceplate member and sealing means for sealing the faceplate member to the faceplate flange. Gauging means are integral with the sealing surface of the flange and form a plane substantially parallel thereto. The gauging means are in contact with the faceplate members so that the faceplate member is sealed parallel to the faceplate flange and at a predetermined distance therefrom.

DETAILED DESCRIPTION OF THE PREFERRED EMBODIMENT

Figure 1:
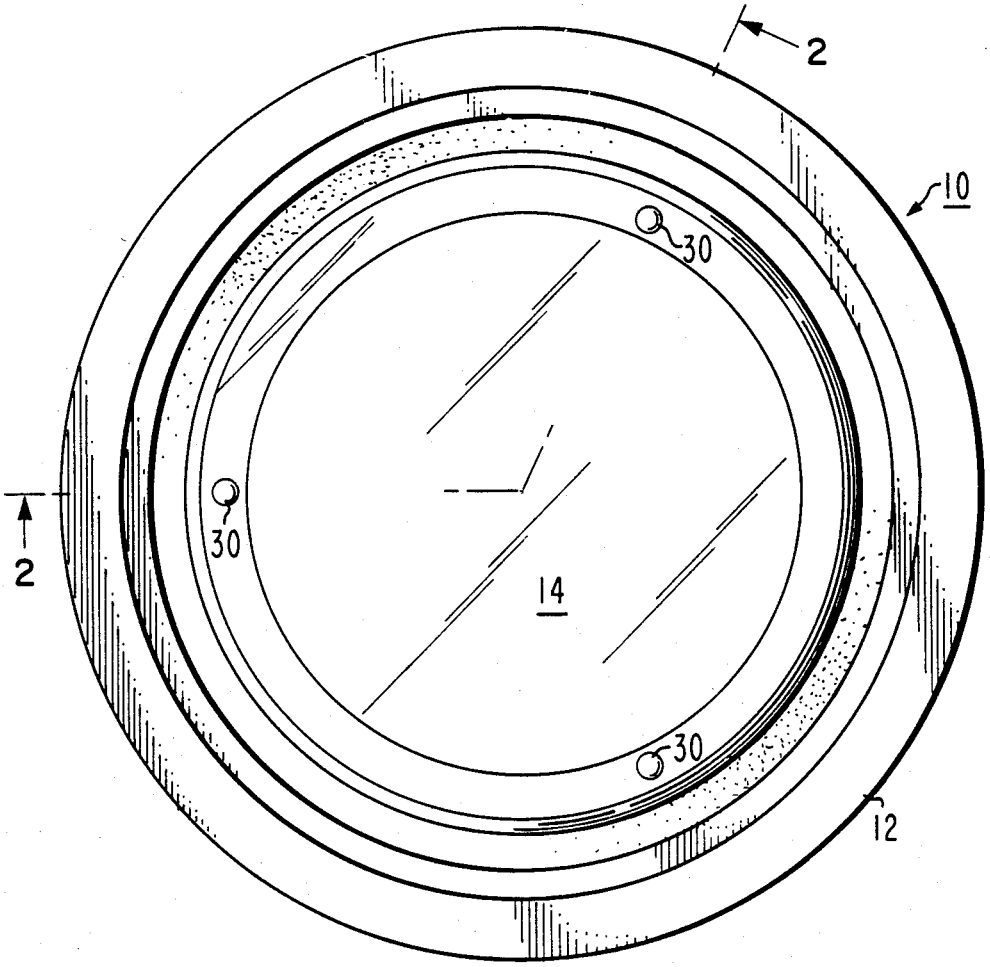
FIG. 1 shows a plan view of a novel faceplate assembly according to the present invention.
Figure 2:
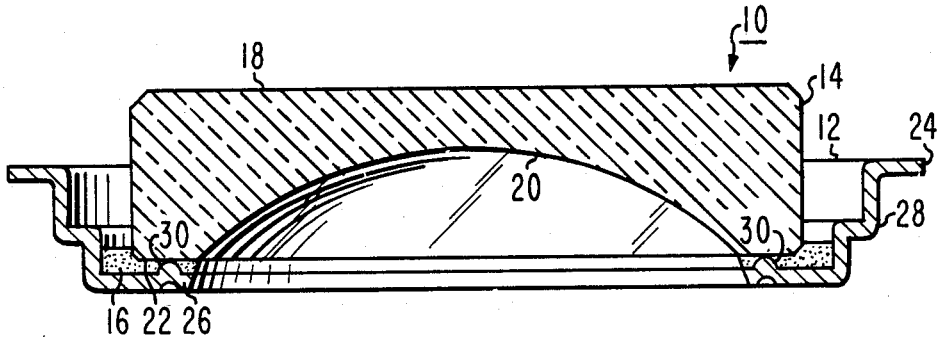
FIG. 2 is a view taken along section lines 2—2 of FIG. 1.

As shown in FIGS. 1 and 2, a novel faceplate assembly 10 comprises a faceplate flange 12, a faceplate member 14 and a sealing material 16, such as glass frit. Preferably, the faceplate member 14 comprises a fiber optic having an exterior surface 18 and an interior surface 20. A fiber optic is preferred, because the fiber optic bundles transmit the optical image from the exterior surface 18 to the interior surface 20 with little dispension and loss in resolution. The interior surface 20 includes a substantially flat annular sealing portion 22 which is substantially parallel to the exterior surface 18. The fiber optic faceplate member 14 is shown as having a plano-concave configuration; however, as is known in the art, the concave surface is required only with inverting imaging devices, such as the diode image intensifier tube shown in FIG. 3. A plano-plano faceplate would be used for proximity focused image intensifier tubes or for magnetically focused image intensifier tubes. As described herein, both the faceplate member 14 and the glass frit 16 are conventional.

The faceplate flange 12 includes a radially extending annular envelope contacting portion 24, a substantially flat, annular sealing surface 26 and a sidewall portion 28 extending therebetween. The annular sealing surface 26 includes a plurality of evenly spaced apart, substantially-identical gauging members 30. As shown in FIG. 1, three substantially identical gauging members 30 spaced 120° apart are required to support the faceplate member 14. Preferably, the gauging members 30 comprise outwardly projecting, domed-shaped bosses which are formed in the sealing surface 26 of the faceplate flange 12; however, shims or spacers (not shown) of equal height, which are attached to the sealing surface 26, are also within the scope of the invention. The apices of the bosses 30 form or define a plane which is substantially parallel to the plane of the sealing surface 26. The diameter of the bosses 30 or shims must be less than the width of the sealing portion 22 of the faceplate 14 so that an adequate amount of frit 16 is in contact with the sealing portion 22 to provide a vacuum-tight seal.

In order to seal the faceplate member 14 to the faceplate flange 12, a quantity of frit 16 is provided on the outside face of the annular sealing surface 26. The frit 16 is trimmed to provide a step to accommodate the faceplate member 14. The inner periphery of the step is cut to a height exactly equal to the height of the bosses 30 so that the sealing portion 22 of the faceplate 14 rests on the bosses 30. A fritting fixture, not shown, supports and centers the faceplate flange 12 and the faceplate member 14 of the faceplate assembly 10 during the frit sealing operation. As is known in the art, the fritting fixture is heated to a sufficiently high temperature to liquidize the frit 16. Upon cooling, a vacuum-tight seal is provided between the sealing portion 22 of the faceplate member 14 and the sealing surface 26 of the faceplate flange 12. The bosses 30 provide two important functions that are not present in the faceplate flanges of the prior art. First, the bosses 30 ensure that the faceplate member 30 is sealed substantially parallel to the faceplate sealing surface 26. The parallelism achieved during frit sealing minimizes the number of finished tubes that must have the faceplates ground to obtain the necessary parallelism. Second, the bosses 30 establish a constant height between the faceplate member 14 and the sealing surface 26 of the faceplate flange 12, thereby ensuring that all points on the interior surface 20 of the faceplate member 14 are an equal distance from the anode of the tube.

Figure 3:
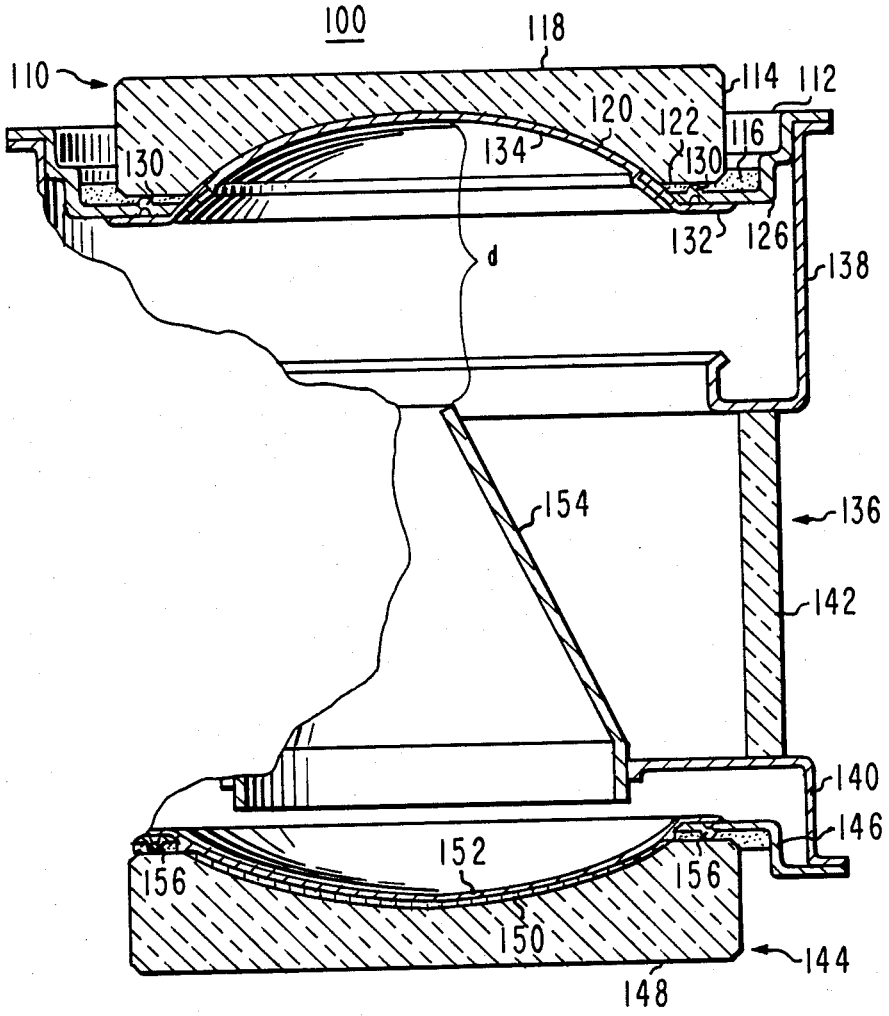
FIG. 3 is a partial longitudinal sectional view of a diode image intensifier tube incorporating the present invention.

A diode image intensifier tube 100, which includes a cathode faceplate assembly 110 according to the present invention, is shown in FIG. 3. The cathode faceplate assembly 110 includes a cathode faceplate flange 112 and a faceplate member 114 sealed together by means of a conventional glass frit 116. The faceplate member 114 comprises a plano-concave fiber optic plate, having an exterior surface 118 and an interior surface 120, with a substantially flat annular sealing portion 122 which is substantially parallel to the exterior surface 118. The sealing portion 122 rests on at least three substantially identical bosses 130 formed in a sealing surface 126 of the flange 112. An annular ring 132 of aluminum or equivalent conductive material is vapor deposited around the periphery of the interior surface 120 of the faceplate member 114, on the underside of the sealing surface 126 and across the glass frit 116 sealing the faceplate member 114 to the sealing surface 126 of the flange 112. A photoemissive cathode 134 is formed by methods well known in the art on the interior surface 120 of the faceplate member 114 and on at least a portion of the ring 132 which provides electrical contact between the cathode 134 and the flange 112.

The cathode faceplate assembly 110 is affixed to and closes one end of an envelope 136 comprising a cathode bulb flange 138, an anode bulb flange 140 and an anode insulator 142. The other end of the envelope 136 is closed by a screen faceplate assembly 144 comprising a screen faceplate flange 146 and a screen faceplate member 148. A phosphor screen 150, with an aluminum coating 152 thereon, is disposed on the interior surface of the screen faceplate 148. Within the envelope 136 is a conical anode 154. The optimum electrostatic focus (i.e., maximum resolution) of the tube 100 is achieved by maintaining a predetermined distance, d, between the interior surface 120 of the cathode faceplate member 114 and the adjacent end of the conical anode 154. Since the present novel cathode faceplate assembly 110 includes bosses 130 which permit the faceplate 114 to always be sealed parallel to and at a constant distance from the sealing flange 126, resolution variations due to faceplate tilt or sealing height variations are eliminated. In the tube 100, the screen faceplate assembly 144 also includes a flange structure similar to that described with respect to the cathode faceplate assembly 110. That is, at least three bosses 156 are provided on a sealing surface 158 of the screen flange 146 to maintain the desired parallelism and spacing between the screen faceplate member 148 and the sealing surface 158 of the screen flange 146.

While the invention is described in the embodiment of a faceplate assembly for a diode image intensifier tube, it should be clear to one skilled in the art that the invention is equally applicable to a wide range of imaging devices where faceplate parallelism and accurate spacing are a consideration.

Furthermore, the structure described herein is not limited to a faceplate assembly sealed by means of glass frit. For example, in application where the input radiation comprises ultraviolet light, a sapphire faceplate (not shown) is frequently used. In such a case, the sapphire faceplate is brazed to a faceplate flange. In this instance, a suitable braze material surrounds the bosses formed in the sealing surface of the faceplate flange to provide a brazed seal between the sealing portion of the sapphire faceplate and the flange.

What is claimed is:

1. In a faceplate assembly including a faceplate flange having a sealing surface, a faceplate member having a substantially flat sealing portion, and sealing means for sealing said faceplate member to said faceplate flange, the improvement comprising gauging means integral with said sealing surface of said faceplate flange and in contact with said substantially flat sealing portion of said faceplate member, said gauging means forming a plane substantially parallel to said sealing surface of said faceplate flange, whereby said faceplate member is sealed parallel to said faceplate flange and at a predetermined distance therefrom.

2. In a faceplate assembly for an imaging device including a faceplate flange having an annular sealing surface, a faceplate member having an exterior surface and an interior surface with a substantially flat sealing portion, and sealing means disposed between said sealing portion of said faceplate member and said sealing surface of said faceplate flange for sealing said faceplate member to said faceplate flange, the improvement comprising three evenly spaced apart, substantially identical gauging members integral with said faceplate flange, said gauging members extending from said flat annular sealing surface of said faceplate flange and defining a plane substantially parallel to said sealing surface, said gauging members contacting said substantially flat sealing portion of said faceplate member for sealing said sealing portion of said faceplate member parallel to said sealing surface of said faceplate flange and at a predetermined distance therefrom.

3. In a faceplate assembly for an imaging device having an evacuated envelope, said assembly including a faceplate flange having a substantially flat annular sealing surface, an annular envelope contacting portion and a sidewall portion extending therebetween, a faceplate member having an exterior surface and an interior surface with a substantially flat sealing portion, said sealing portion of said interior surface being parallel to said exterior surface of said faceplate member, and a heat-activated sealing material disposed between said sealing portion of said faceplate member and said sealing surface of said faceplate flange for sealing said faceplate member to said faceplate flange, the improvement comprising three bosses integral with and protruding outwardly from said flat annular sealing surface of said faceplate flange, the apices of said bosses lying in a plane that is substantially parallel to said sealing surface of said faceplate flange, said bosses contacting said substantially flat sealing portion of said faceplate member for sealing said faceplate member parallel to said sealing surface of said faceplate flange and at a predetermined distance therefrom.

* * * * *